US007285366B2

(12) United States Patent
Itami et al.

(10) Patent No.: US 7,285,366 B2
(45) Date of Patent: Oct. 23, 2007

(54) ORGANIC PHOTORECEPTOR, AN IMAGE FORMING METHOD, AN IMAGE FORMING APPARATUS AND A PROCESS CARTRIDGE

(75) Inventors: Akihiko Itami, Hachioji (JP); Shigeki Takenouchi, Chofu (JP); Satoshi Uchino, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 310 days.

(21) Appl. No.: 10/952,128

(22) Filed: Sep. 28, 2004

(65) Prior Publication Data

US 2006/0068307 A1 Mar. 30, 2006

(51) Int. Cl.
*G03G 5/047* (2006.01)
*G03G 5/147* (2006.01)

(52) U.S. Cl. ..... 430/56; 430/58.5; 399/159

(58) Field of Classification Search ..... 430/56, 430/66, 58.05; 399/159
See application file for complete search history.

(56) References Cited

U.S. PATENT DOCUMENTS 6,194,106 B1 * 2/2001 Bretscher et al. ..... 430/18
6,534,228 B2 * 3/2003 Kawada et al. ..... 430/66

FOREIGN PATENT DOCUMENTS

JP 01-205171 A 8/1989
JP 03-155558 A 7/1991
JP 04-175767 A 6/1992
JP 05-341551 A 12/1993
JP 08-202062 A 8/1996
JP 08-262756 A 10/1996
JP 08-320588 A 12/1996
JP 09-152775 A 6/1997
JP 09-190125 A 7/1997
JP 10-020513 A 1/1998
JP 11-316467 A 11/1999
JP 2000-314978 A 11/2000
JP 2001-066800 A 3/2001
JP 2001-142246 A 5/2001
JP 2001-166504 A 6/2001
JP 2001-166522 A 6/2001
JP 2001-201881 A 7/2001

(Continued)

OTHER PUBLICATIONS

AEROSIL Nihon Aerosil Co., Catalog, Apr. 2002.
Technical Bulliten Aerosil "Basic characteristics of hydrophobic AEROSIL and practical application to paints" No. 13 Revision 96 96, 4. Table 1, "3. 2. 3 methanol wettability".

(Continued)

*Primary Examiner*—John L Goodrow
(74) *Attorney, Agent, or Firm*—Lucas & Mercanti, LLP

(57) ABSTRACT

An organic photoreceptor for an electro-photography, comprising a conductive support member and at least a light sensitive layer, an comprising a toner image forming surface of the photoreceptor having a surface roughness Ra between 0.02 μm and 0.1 μm and a surface roughness Rz between 0.1 μm and 1 μm, and an image forming apparatus comprising the same are disclosed.

28 Claims, 3 Drawing Sheets

FOREIGN PATENT DOCUMENTS

| | | | |
|---|---|---|---|
| JP | 2001-228643 | A | 8/2001 |
| JP | 2001-255682 | A | 9/2001 |
| JP | 2001-265040 | A | 9/2001 |
| JP | 2001-265040 | A | 9/2001 |
| JP | 2001-296683 | A | 10/2001 |
| JP | 2001-318475 | A | 11/2001 |
| JP | 2002-062778 | A | 2/2002 |
| JP | 2002-091043 | A | 3/2002 |
| JP | 2002-116580 | A | 4/2002 |

* cited by examiner

ORGANIC PHOTORECEPTOR, AN IMAGE FORMING METHOD, AN IMAGE FORMING APPARATUS AND A PROCESS CARTRIDGE

BACKGROUND

Technical Field

The present invention relates to an organic photoreceptor used in the field of copy machines and printers, an image forming method, an image forming apparatus, and a process cartridge, using the organic photoreceptor.

In recent years, as electrophotographic photoreceptors, photoreceptors containing an organic photoconductive material are most widely employed. Organic photoreceptors (hereinafter, also referred to simply as photoreceptor) have advantages over other photoreceptors in easiness of developing materials required for various exposure sources for lights including visible lights and infrared lights; selectability of materials free from environmental contamination; and low manufacturing cost, also being excellent in charging stability and electrical potential maintainability. On the other hand, since organic photoreceptors have a large adhesion force with toner made of the same organic matter, it is necessary to control cleaning of removing residual toner more precisely than the case of inorganic photoreceptor of selenium, amorphous silicon, etc. Further, organic photoreceptors have disadvantages including the characteristic of getting worn easily by abrasion on the surface of the photoreceptor during cleaning.

Facing the above problems, as methods for improving cleanability of residual toner on an organic photoreceptor and resistance against abrasion, in TOKKAISHO No. 56-117245, TOKKAISHO No. 63-91666, and TOKKAIHEI No. 1-205171, it is described that durability can be improved by providing silica particles in the uppermost surface layer of a photoreceptor to make the mechanical strength of the surface of the photoreceptor great. Further, TOKKAISHO No. 57-176057, TOKKAISHO No. 61-117558, and TOKKAIHEI No. 3-155558, it is described that a photoreceptor with a still higher durability can be obtained by providing hydrophobic silica particles, manufactured by processing of the above silica particles with a silane coupling agent or the like, into the uppermost surface of the photoreceptor to make the mechanical strength of the photoreceptor great, and by giving lubricity.

Further, as a method for removing toner easily by providing inorganic particles such as hydrophobic silica particles described-above into the surface layer of a photoreceptor, and making the surface roughness in a specific range, TOKUGAN No. 2000-71738 discloses a patent that specifies the average surface roughness Ra of a square 5 μm on a side to be in the range from 1.5 to 100 nm.

Although transferability and cleaning ability of toner can be improved for a photoreceptor provided with inorganic particles in the surface layer as described above, a cleaning method using a rubber blade (hereinafter referred to as blade cleaning) tends to cause a phenomenon of generating "blade-twisting", which means turning of a blade in reverse, or a friction sound, which is called "blade-singing". Accordingly, the above problems cannot be solved by only providing the above hydrophobic silica particles or the like onto the surface of the photoreceptor, and making the surface roughness in the range from 1.5 to 100 nm for Ra.

SUMMARY

There is provided an organic photoreceptor, a process cartridge, an image forming method, and an image forming apparatus, using the organic photoreceptor, wherein the organic photoreceptor has a surface roughness equal to or greater than 0.02 μm and smaller than 0.1 μm for Ra and equal to or greater than 0.1 μm and smaller than 1 μm for Rz with regard to the surface that forms a toner image.

DETAILED DESCRIPTION OF THE EXEMPLARY EMBODIMENT

Figure 1:
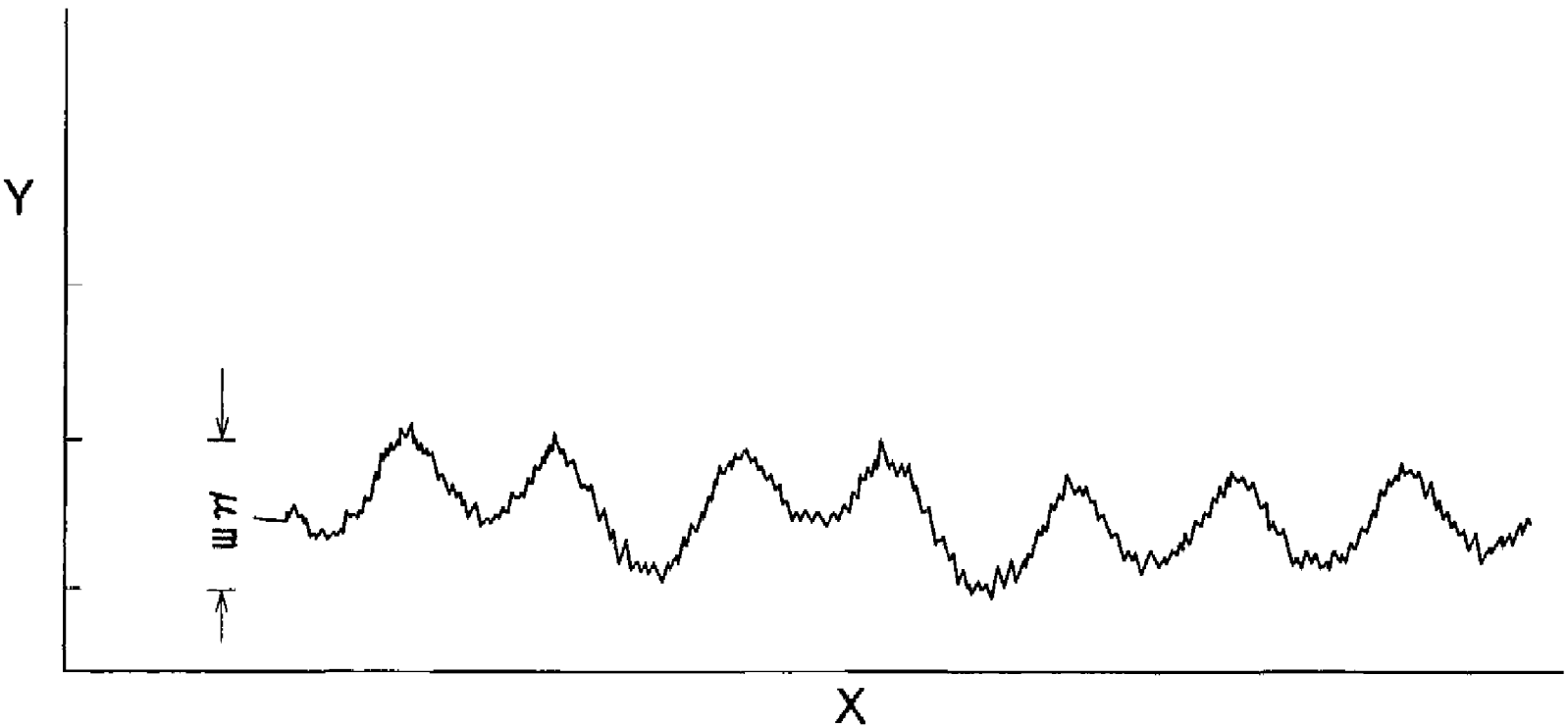
FIG. 1 is a diagram showing an example of measured data of the surface roughness of a photoreceptor having a surface roughness in accordance with the invention.

In a first aspect, there is provided an organic photoreceptor having a surface roughness equal to or greater than 0.02 μm and smaller than 0.1 μm for Ra and equal to or greater than 0.1 μm and smaller than 1 μm for Rz with regard to the surface that forms toner images. The organic photoreceptor is preferably provided with a conductive support and at least a light sensitive layer.

Further, the surface layer of the above organic photoreceptor preferably contains particles with a number average primary particle diameter equal to or greater than 1 nm and smaller than 100 nm.

With the above mentioned structure, it is possible to provide an organic photoreceptor, wherein transferability and cleaning ability of toner is improved, blade turning or blade sounding does not occur, and resistance against abrasion is improved.

Specifically, the surface of the organic photoreceptor is formed with a minute surface roughness Ra and an undulate surface roughness Rz superimposed on this Ra. Thus, the transferability and cleaning ability of toner on the photoreceptor is improved even using a toner, such as polymer toner, having a great adhesion force to a photoreceptor, blade-twisting or blade-singing does not occur, and resistance against abrasion is significantly improved.

The number average diameter of the inorganic particles is preferably from 1 nm to less than 100 nm, more preferably from 10 nm to 90 nm, and is most preferably from 10 nm to less than 50 nm. Containing particles having in these range, the photoreceptor has an adequate fine roughness and minimizes amount of water carried into the surface layer, and therefore improvement of toner transfer ability and cleaning characteristics becomes greater and it is easy to prevent cleaning defect.

As the inorganic particle having the number average diameter of not less than 1 nm and less than 100 nm, fine particles of silica, zinc oxide, titanium oxide, tin oxide, antimony oxide, indium oxide, bismuth oxide, tin-doped indium oxide, antimony- or tantalum-doped tin oxide and zirconium oxide are preferably employed.

Of these, silica, particularly hydrophobic silica hydrophobilized on the surface thereof, is preferred from the viewpoint of the cost and the facility of the diameter control and the surface treatment.

The number average primary particle diameter of the inorganic particles is defined by the number average of the Fere diameter according to the image analyzing of 300 primary particles randomly selected from an electron microscopic image with a magnitude of 10,000.

The hydrophobicity of the hydrophobic inorganic minute particles is preferably 50% or more in terms of methanol wettability that is a measure of wettability against methanol. In case that the hydrophobicity is not more than 50%, a surface layer tends to easily absorb water, and therefore, adhesion force of toner becomes greater, transferability of toner reduces, abrasion of cleaning blade is increased, and cleaning defect tends to occur easier. Preferable hydrophobicity is 65% or more and more preferably 70% or more.

The methanol wettability representing hydrophobicity is, exemplified with silica, to evaluate the wettability of silica powder to methanol. In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given (1):

(1) Degree of hydrophobicity=a/(a+50)×100 wherein "a" (in ml) represents the amount of methanol required for making fine inorganic particles perfectly wet. The above-mentioned hydrophobic silica can be obtained by hydrophobilizing silica powder generated with a well-known wet method or a well-known dry process. Especially, a hydrophobic silica in which a so-called fumed silica generated by a dry process (vapor phase oxidation of a siliconized halogen compound) is processed with a hydrophobilizing agent is desirable, because water content adsorption sites are few. This is a product conventionally manufactured by well-known technology. For example, the technology utilizes a pyrolysis oxidation reaction in the hydrogen oxide flame of silicon tetrachloride gas, and an equation used as a fundamental is as follows.

$$S_iCl_4+2H_2+O_2 \rightarrow S_iO_2+4HCl$$

Moreover, in this manufacturing process, it is also possible to acquire a compound fine powder of silica and other metal oxides by using other metal halogenated compounds, such as an aluminium chloride or a titanium chloride, with a silicon halogenated compound.

The hydrophobilizing process of silica powder can be performed by the following conventionally well-known methods:

a dry processing in which for silica fine powder dispersed in a state of a cloud by stirring, a hydrophobilizing process agent solution dissolved in alcohol is sprayed to the powder or an evaporated hydrophobilizing process agent is contacted and is made to adhere to the powder, or a wet processing which distributes the silica powder in a solution and drops a hydrophobilizing process agent and adhere to the powder.

A well-known compound can be used as the hydrophobilizing process agent, and a concrete example is listed below. Moreover, these compounds may be combined and used.

As a titanium coupling agent, tetrabutyl titanate, tetraoctyl titanate, isopropyltri isostearoyl titanate, isopropyltridodecylbenzenesulfonyl titanate, bis(dioctylpyrophosphate)oxyacetate titanate, etc. can be listed.

As a silane coupling agent, γ-(2-aminoethyl) aminopropyltrimethoxysilane, γ-(2-aminoethyl) aminopropylmethyldimethoxysilane, γ-methacryloxypropyltrimethoxysilane, a N-β-vinyl benzyl aminoethyl-N-γ-aminopropyltrimethoxysilane hydrochloride, Hexa methyldisilazane, a methyltrimethoxysilane, a butyltrimethoxysilane, an isobutyl trimethoxysilane, a hexyltrimethoxysilane, a octyl trimethoxysilane, a desyltrimethoxysilane, a dodesyltrimethoxysilane, a phenyltrimethoxsilane, o-methylphenyl trimethoxysilane, p-methylphenyl trimethoxysilane, etc. may be listed.

As a silicone oil, dimethylsilicone oil, methylphenylsilicone oil, amino-modified-silicone oil, etc. are may be listed.

As for these hydrophobilizing process agents, it is desirable to add 1-40 weight % for silica powder so as to cover the silica powder, and to add 3-30 weight % is more desirable.

Moreover, a hydrogenpolysiloxane compound may be used as the above-mentioned surface hydrophobilizing agent. Generally, as for this hydrogenpolysiloxane compound, the compound having a molecular weight of 1000-20000 may be obtainable, and its black spot occurrence prevention function is also good. Especially, a good effect may be acquired if methylhydrogenpolysiloxane is used for the last surface treatment.

In the present invention, in the case where a surface layer of an organic photoreceptor is made to contain with a binder a hydrophobic silica to which the abovementioned hydrophobilizing process was carried out, the rate of silica particles to a binder on a surface layer may be used at 1 to 20 weight %, preferably 2 to 15 weight %, and more preferably 2 to 10 weight %. By holding the above range, it make it possible to reduce a surface layer to absorb water content and to keep the good adhering ability of the surface layer with toner. As a result, the toner transferring ability and the cleaning ability for toner and the wear-resistance ability can be improved.

A ten-point surface roughness Rz of the surface that forms toner images of the organic photoreceptor between 0.1 and less than 1.0 μm is preferable. The cleaning ability of toner can be maintained good by making the ten-point surface roughness of a photoreceptor within the above range and by superimposing the roughness with the surface roughness of above mentioned Ra, and also blade-twisting and blade-singing are prevented and the wear resistance of a photoreceptor is improved.

Hereafter, the surface roughness Ra (arithmetic average roughness and Rz (ten-point average roughness) are explained (although JISB 0601-1994 can be applied correspondingly, a reference length cutoff value is specified as follows).

Surface Roughness Ra

Only a reference length is sampled in the direction of that average line from a roughness curve, an X-axis is taken in the direction of the average line of this sampling part, and a Y-axis is taken in the direction of longitudinal magnification, and Ra is represented with the micrometer (μm) of the value calculated by the following formula, when the roughness curve is expressed with y=f(x).

$$Ra=1/l\int_0^1|f(x)|dx$$

Where l is a reference length.

In this invention, l is 2.5 mm and a cutoff value is 0.08 mm.

The ten-point surface roughness Rz is a difference between an average height of five peaks from the highest peak and an average lowness of five valleys from the lowest valley within the distances of 2.5 mm of the reference length.

These Ra and Rz can be measured with a surface roughness meter (Surfcorder SE-30H manufactured by a Kosaka Laboratory Ltd. company).

Measurement Condition of The Surface Roughness Ra and Rz

Measurement speed (Drive speed: 0.1 mm/second)

Measurement needle diameter (Stylus: 2 μm)

However, as long as an instrument produces the same result within allowable errors, other instruments may be used.

The Measurement Condition of Surface Roughness

Average roughness Ra and Rz are calculated as an average value by the following methods respectively.

Figure 3:
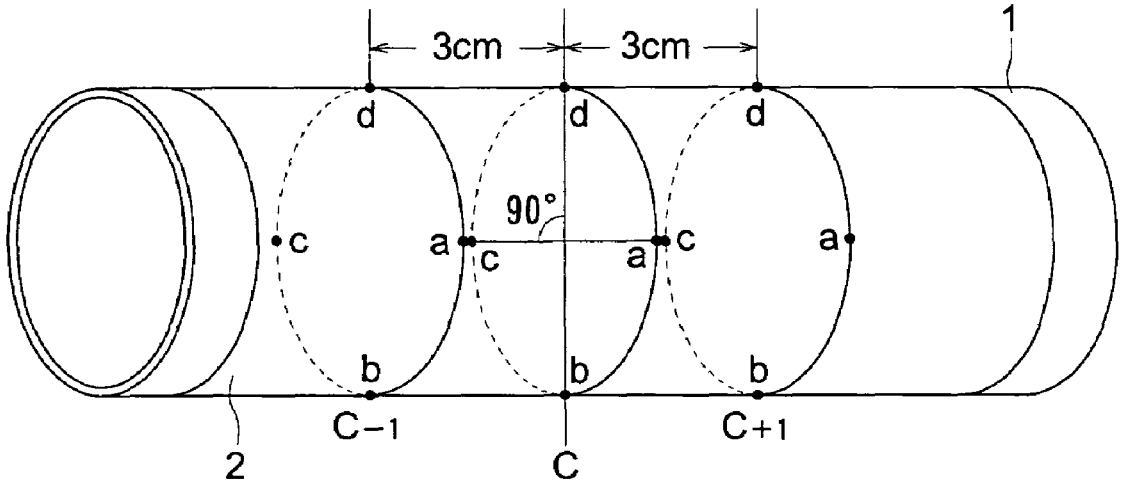
FIG. 3 is a diagram showing an electrophotographic photoreceptor drum and measurements of Ra and Rz.

If explaining with reference to FIG. 3, roughness is measured for a central part C, and four positions placed apart by 3 cm from the central part C in right angle directions from each others in sectional directions Rz are average values of these measurements. Incidentally, this measure is also conducted for a belt type photoreceptor.

A method of making a surface of a conductive base support constituting this photoreceptor to be rough is effective as a method of controlling the ten-point surface roughness Rz of the photoreceptor within the range of 0.1 and less than 1.0 μm.

The surface roughness Ra of the surface that forms toner images of the photoreceptor is 0.02 μm or more and less than 0.1 μm, preferably, it may be 0.03 μm or more and 0.06 μm or less. On the other hand, Rz of the surface that forms toner images of the photoreceptor is 0.1 μm or more and less than 1 μm, preferably, it may be 0.3 μm or more and 0.85 μm or less.

As a material of the conductive base support, a material formed in a shape of belt or a shape of drum by using mainly a metal material, such as aluminum, a copper, a brass, a steel, and a stainless steel and the other plastics may be used. Especially, an aluminum excellent in cost, workability, etc. may used preferably, and usually a thin cylinder-like aluminum pipe formed an extrusion shaping or a drawing-out shaping are used in many cases.

As a condition of a roughened surface of the conductive base support, it may be preferable that the ten-point average surface roughness Rz is larger than 0.3 μm and 5.0 μm or less. The surface roughness of 0.4 μm or more and 4.0 μm or less is more desirable, and not less than 0.5 μm and less than 2.5 μm are the most desirable. By coating an intermediate layer and a light sensitive layer on the conductive base support which has such surface roughness Rz, the surface roughness Rz of the surface layer of the photoreceptor can be controlled. And the photoreceptor which made Ra superimpose on above Rz can be obtained by providing a light sensitive layer having a surface layer containing the above mentioned inorganic particles on conductive base support. The Ra of the surface layer can be controlled by a size of added particles and an added amount.

A method to roughen the surface of a support as described above includes a method in which a support surface is cutting roughened by such as a cutting tool, a sandblast method by clashing fine particles against the support surface, a manufacturing method by use of a washing device by ice-particles described in JP-A 4-204538, and a method of a horning process described in JP-A 9-236937. Further, an anodic oxidation method or Alumite treating method, a buff process method, a method by laser evaporation method described in JP-A 4-233546, a method by polishing tape described in JP-A 8-1502, and a method of roller vanishing process described in JP-A 8-1510 are listed. However, a method to roughen the surface of a support is not limited thereto.

FIG. 1 shows a surface roughness measurement data of the photoreceptor which has the surface roughness of this invention. The X-axis of FIG. 1 shows a measurement reference length direction, and the Y-axis shows surface convexo-concave. The following states are found out from this figure that on the convexo-concave of the surface of a photoreceptor, the small convexo-concave of the inorganic particles of a surface layer are superimposed on a large undulation on which the roughness of a conductive base support is reflected on the surface.

Adhesion with toner can be reduced by adopting the organic photoreceptor which has the surface layer of the above structure. As a result, while improving the toner transferring ability and cleaning ability for toner, blade-peeling and a blade-singing are prevented, and the wear resistance of a photoreceptor is improved, it can provide a electrophotography picture image in which good sharpness can be maintained for a long period of time.

Hereafter, the structure of the organic photoreceptor applied to this invention other than the surface layer is described.

An organic photoreceptor means the electrophotography photoreceptor constituted by giving at least one function of an electric charge generating function and an electric charge transportation function indispensable to the structure of an electrophotography photoreceptor to an organic compound. The organic photoreceptor includes all organic well-known electrophotography photoreceptors, such as a photoreceptor which is composed of well-known organic electric charge generating substance or organic electric charge transportation substance, and a photoreceptor in which the electric charge generating function and the electric charge transportation function are constituted from a macromolecule complex.

The layer structure of the organic photoreceptor is composed of light sensitive layers, such as a charge generation layer, a charge transporting layer, or electric charge generating charge transporting layer (layer which has the function of electric charge generating and electric charge transportation in the same layer) provided on a conductive base support fundamentally. The structure of having coated a surface layer having the layer characteristics of this invention on the light sensitive layer may be used, however, the most desirable structure is the structure in which the light sensitive layer is constituted from a charge generation layer and plural charge transporting layers and the charge transporting layer of a top layer is made as the surface layer of this invention.

Practical example of the photosensitive layer composition is described.

Electroconductive Support

An electroconductive support having a sheet shape or cylinder shape is used.

The cylindrical electroconductive support is a cylindrical support on which images can be endlessly formed by its rotation. The electroconductive support having a straightness of not more than 0.1 mm and a swing width of not more than 0.1 mm is preferred.

A drum metal such as aluminum or nickel, a plastic drum on the surface of which aluminum, tin oxide or indium oxide is provided by evaporation, and a plastic and paper drum each coated with an electroconductive substance may be used as the material of an electroconductive support. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Interlayer

In the present invention, an interlayer, functioning as a barrier, may be provided between the electrically conductive support and the photosensitive layer.

It is preferable that the intermediate layer includes titanium oxide in the aforementioned binder resin whose absorption coefficient is small. The average particle diameter of the titanium oxide particles is preferably in the range between 10 nm and 400 nm and more preferably in the range between 15 nm and 200 nm in terms of the number-based average primary particle diameter. If the size is smaller than 10 nm the effect of preventing Moire generation in the intermediate layer is small. On the other hand, if the size exceeds 400 nm, occurrence of precipitation of the titanium oxide particles in the intermediate layer coating solution becomes likely, and as a result, the uniform distribution of the titanium oxide particles in the intermediate layer becomes poor, and also an increase in black spotting is likely to occur. The intermediate layer coating solution using titanium oxide particles for which number-based average primary particle diameter is in the range defined above is favorable, and the intermediate layer that is formed from this type of coating solution functions to prevent the generation of black spotting, and in addition, is favorable in terms of environmental properties and its resistance to cracking.

The titanium oxide particles may have a dendrite, needle shaped, or granular configuration, and the titanium oxide particles having these configurations may for example be a crystalline type such as an anatase type, a rutile type or an amorphous type for the titanium oxide crystal. Any of the crystal types may be used, and 2 or more of the crystal types may be mixed and used. Among these, the rutile type and the granular type are most favorable.

It is preferable that the titanium oxide particles of the present invention undergo surface treatment, and one surface treatment involves carrying out multiple surface treatments, and the last of the multiple surface treatments is one in which a surface treatment using a reactive organic silicon compound is carried out. In addition at least one of the plurality of surface treatments is one in which surface treatment with at least one substance selected from alumina, silica, and zirconia is done, and it is preferable that the surface treatment using the organic silicon compound is carried out at the last step.

The alumina treatment, the silica treatment and the zirconia treatment are each the treatment for precipitating alumina, silica and zirconia on the surface of the titanium oxide, respectively. The alumina, silica and zirconia precipitated onto the surface each include the hydrated compound thereof, respectively. The surface treatment by the reactive organic silicon compound is a treatment employing the reactive organic silicon compound.

As above-mentioned, the surface of the titanium oxide particle is uniformly covered by applying at least twice surface treatments. When such the surface treated titanium oxide particles are employed in the interlayer, the stability of the titanium oxide particles dispersion in the interlayer and a good photoreceptor without occurring of the image defects such as the black spots can be obtained.

Examples of the reactive organic silicon compound include the compounds represented by the following Formula 1, but any compounds capable of reacting with the reactive group on the surface of the titanium oxide such as a hydroxyl group are usable.

$$(R)n—Si—(X)_{4-n} \qquad \text{General Formula (1)}$$

wherein R represents an organic group in which a carbon atom directly bonds to a silicon atom, X represents a hydroxyl group or a hydrolyzable group, and n represent an integer of 0 to 3.

In organic silicon compounds represented by General Formula (1), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl) ethyl, and the like; an acryloyl or methacryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β(aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolizable groups represented by X are an alkoxy group such as methoxy, ethoxy, and the like, a halogen atom, and an acyloxy group.

Further, organic silicon compounds represented by General Formula (1) may be employed individually or in combinations of two or more types.

Further, in the specific organic silicon compounds represented by General Formula (1), when n is at least 2, a plurality of R may be the same or different. In the same manner, when n is not more than 2, a plurality of X may be the same or different. Still further, when at least two types of organic silicon compounds represented by General Formula (1) are employed, R and X, in each compound, may be the same or different.

Polysiloxane compounds may be employed as a reactive organic silicon compound used in surface treatment. The hydrodienepolysiloxane having a molecular weight of from 1,000 to 20,000 is usually available and shows satisfactory black spot preventing effect.

Suitable effect can be obtained when methylhydrodienepolysilxane is used for the final surface treatment.

Charge Generating Layer

A charge generating layer contains a charge generating material (CGM). In addition, the charge generating layer may contain a binder resin and other additives as necessary. As the charge generating material (CGM), for example, phthalocyanine pigment, azo pigment, a perylene pigment, an azulenium pigment can be applied.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight parts for charge generating material 20 to 600 weight parts. Increase in residual electric potential with repeated use can be minimized by using these resins. The layer thickness of the charge generating layer is preferably in the range of 0.01 to 2 μm.

Charge Transporting Layer

Charge transporting layer is composed of a plurality of charge transporting layers. It is preferable that the outermost layer of the charge transporting layers is arranged as a surface layer.

A charge transporting layer contains a charge transporting material (CTM) and a binder resin for dispersing the CTM and forming a layer. In addition, the charge transporting layer may contain additives such as an antioxidant agent as necessary.

As a charge transporting material (CTM), a known charge transporting material (CTM) can be used. For example, triphenylamines, hydrazones, styryl compound, benzidine compound, butadiene compound can be applied. These charge transporting materials are usually dissolved in a proper binder resin to form a layer. Among these, CTMs which can minimize increase in residual electric potential due to repeated use have a high mobility and a characteristic that the ionization potential difference from that of a CGM to be combined is not greater than 0.5 eV, and preferably not greater than 0.30 eV.

An ionization potential of CGM and CTM can be measured with a surface analysis apparatus AC-1 (a product made in Riken Keiki company).

As a resin used for the charge transporting layer (CTL), for example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resins, high polymer organic semiconductor such as poly-N-vinyl carbazole may be usable. The most preferred material is polycarbonate resin as a binder of these CTLs in view of dispersing ability of the CTM and electrophotosensitive characteristics.

Ratio of the binder resin is preferably 50 to 200 parts by weight to 100 parts of charge transporting material by weight.

Further it is preferable that film thickness of the charge transporting layer is 10-50 μm. Charging potential may be insufficient when the layer is not more than 10 μm, and sharpness may deteriorate when the thickness exceeds 50 μm.

In the foregoing, a solvent or a dispersion medium used for forming an intermediate layer, a photosensitive layer and a protective layer is not restricted in particular, and what is used preferably includes, for example, n-butylamine, diethylamine, ethylenediamine, isopropanolamine, triethanolamine, triethylenediamine, N,N-dimethylformamido, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve. Among the foregoing, dichloromethane, 1,2-dichloro ethane and methyl ethyl ketone are used preferably. Further, these solvents or dispersion media may also be used either independently or as mixed solvents of two or more types.

As a coating method for manufacturing an organic electrophotographic photoreceptor, there are used coating methods for immersion coating, spray coating and coating of a circular amount control type, however, it is preferable to use the coating method for spray coating or for coating of a circular amount control type (represented by a circular slide hopper type) so that a membrane of a lower layer may not be dissolved to the utmost by the coating operation for the upper layer in the photosensitive layer and uniform coating may be attained. Further, for the protective layer, it is preferable to use a coating method of a circular amount control type which is described in detail in, for example, JP-A No. 58-189061.

The image forming method is described.

Figure 2:
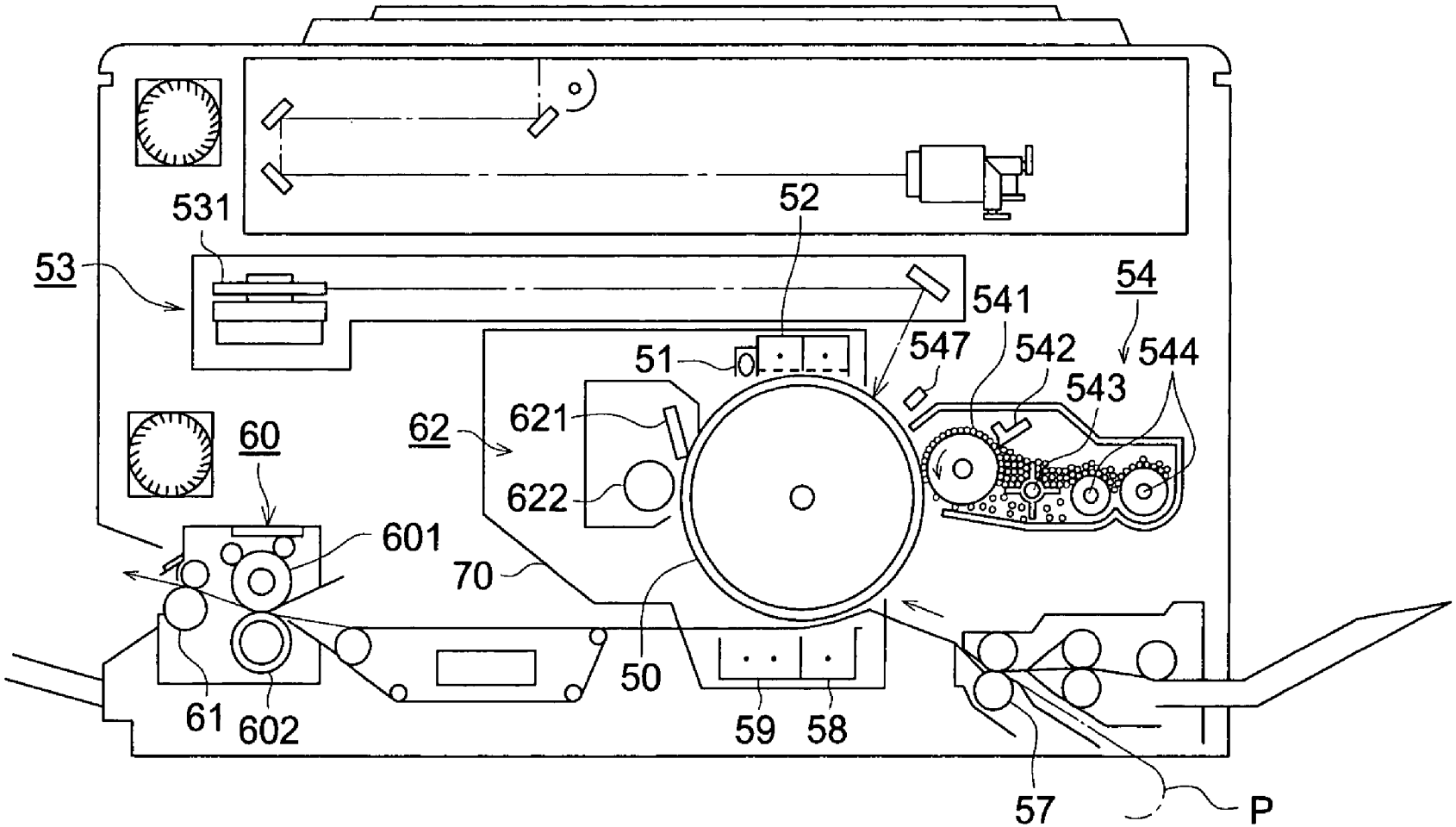
FIG. 2 is a cross-sectional view of an image forming apparatus as an example of the invention.

FIG. 2 shows a cross-sectional view of image forming apparatus showing an example of the image forming method of this invention.

In FIG. 2, 50 is a photoreceptor drum as an image carrier which is a photoreceptor comprising a drum and an organic photosensitive layer coated on the drum; the drum is grounded and driven so as to be clockwise rotated. 52 is a scorotron charging device as a charging means which provides uniform charge onto the circumference surface of the photoreceptor drum 50 by corona discharge. The remaining charge on the drum surface may be removed before charging by the charging device 52 by using a pre-exposing device 51 having a light emission diode for erasing the history.

After the uniformly charging to the photoreceptor, imagewise exposure according to the image information is given by an image exposure device 53 as an image exposing means. The light source of the exposing device 53 is a laser diode which is not shown in the drawing. A static latent image is formed by scanning by light beam along the optical pass introduced by a reflection mirror through a rotating polygon mirror 531 and an fθ lens.

The reversal developing process is a developing process in which the photoreceptor surface is uniformly charged by the charging device 52 and the potential of the imagewise exposed area or the exposed area potential is visualized by a developing means. Besides, the unexposed area is not visualized by the bias. potential applied to the developing sleeve 541.

Then the static latent image is developed by a developing device 54 as a developing means. The developing device 54 including a developer comprising a toner and a carrier is arranged around the photoreceptor drum 50, and the development is performed by the developing sleeve 541 including a magnet and rotated while holding the developer. The interior of the developing device 54 is constituted by a developer stirring and conveying member 544 and 543 and a conveying developer amount regulation member 542, and the developer is stirred, conveyed and supplied to the developing sleeve. The supplying amount of the developer is regulated by the conveying amount regulating member 542. The conveying amount of the developer is usually from 20 to 200 mg/cm$^2$ even though the amount is varied depending on the line speed of the electrophotographic photoreceptor and the specific gravity of the developer.

The developer is composed of the carrier composed of a ferrite core coated with an insulation resin and the toner composed of a colored particle comprising the styrene-acryl resin as the principal component, the charge controlling agent and low molecular weight polyolefin, and the external additive such as silica and titanium oxide. The developer is conveyed into the developing zone while the layer thickness thereof is regulated by the conveying toner amount regulation member, and the development is performed. On this occasion, the development is performed while usually applying direct current bias, and alternative current bias according to necessity, between the photoreceptor drum 50 and the developing sleeve 541. The development is performed in the status in which the developer is contacted or non-contacted with the photoreceptor. The potential of the photoreceptor is measured by a potential sensor 547 equipped at the upper portion of the developing zone as shown in FIG. 2.

Recording paper P is supplied into the transferring zone by the rotation of a paper supplying roller 57 synchronously with the timing of transferring after the image formation.

In the transferring zone, the transfer electrode 58 is acted to the circumference of the photoreceptor drum 50 synchronously with the timing of transfer to apply the charge having the polarity reversal to that of the toner to the recording paper P for transferring the toner.

The charge of the recording paper P is removed by a separation electrode or separating device 59, and the recording paper P is separated from the circumference of the photoreceptor drum 50 and conveyed into the fixing device 60. In the fixing device the toner is fused and fixed onto the paper by heating and pressing by a heating roller 601 and a pressing roller 602 and then taken out from the apparatus through a outputting roller 61. The transfer electrode 58 and separation electrode 59 are temporarily stopped after passing of the recording paper P for preparing to the next image formation. In FIG. 1, a scorotron transfer electrode is used. Conditions of the transfer electrode are set at, for example, a transfer current of from +100 to +400 μA and transfer voltage of from +500 to +2,000 V even through the conditions cannot be simply limited since the conditions are varied depending on the processing speed or circumference speed of the photorecepter.

The toner remained on the photoreceptor drum 50 after the separation of the recording paper P is removed and the drum surface is cleaned by a cleaning blade 621 of a cleaning device or cleaning means 62 pressed to the drum, and then subjected to the exposure before charging by the pre-exposing device 51 and to the charging by the charging device 52. Thus the photoreceptor drum 50 is entered to the next image forming process.

Numeral 70 is a processing cartridge capable of freely installing in and releasing from the apparatus, in which the photoreceptor, the charging device, the transferring device, the separation device and the cleaning device are unitized.

The electrophotographic photoreceptor according to the invention is suitable for an electrophotographic photoreceptor, a laser printer, a LED printer and a liquid crystal shutter type printer. Moreover, the photoreceptor can be widely applied to an apparatus utilizing electrophotographic technology for display, recording, light printing, plate making and facsimile.

The present invention is explained in detail with reference to examples mentioned below, to which are not to restrict the invention. The term "part" means part by weight.

EXAMPLE

Preparation of Photoreceptor 1

Photoreceptor 1 was prepared in the following manner.

(Electrically Conductive Support)

An aluminum ingot was processed to a cylindrical shape having an outer diameter of 100 mm, a length of 346 mm and the surface was finished by cutting so as to have a surface roughness Rz of 1.5 μm.

| (Interlayer) | |
|---|---|
| Titanium chelate compound TC-750 (Matsumoto Seiyaku Co., Ltd.) | 30 parts |
| Silane coupling agent KBM-503 (Shin-Etsu Kagaku Kogyo Co., Ltd.) | 17 parts |
| 2-Propanol | 150 parts |

The resulting coating composition of an interlayer was coated on the above-mentioned support to have a dry thickness of 0.5 μm.

| (Charge Generating Later) | |
|---|---|
| Y type titanylphthalocyanine (titanylphthalocyanine which has the maximum peak at 27.2 degrees of the Bragg angle 2θ (±0.2) by Cu—Kα characteristic-X-rays diffraction spectrum measurement) | 60 parts |
| Silicone-modified-butyral resin (X-40-1211M: manufactured by a Shin-Etsu Chemical Co., Ltd. company) | 700 parts |
| 2-butanone | 2000 parts |

The above-mentioned compositions were mixed and dispersed for 10 hours using the sand-mill so that a charge generation layer coating solution was prepared. This coating solution was coated by an impregnation coating method on the above-mentioned intermediate layer, and a charge generation layer of 0.2 μm of thickness of dried coating layer was formed.

| <Charge transporting layer> | |
|---|---|
| Charge transportation material (4,4'-dimethyl-4''-(α-phenylstyryl) triphenylamine) | 225 parts |
| Polycarbonate (Z300: manufactured by a Mitsubishi Gas Chemical Company INC. company) | 300 parts |
| Antioxidant (Irganox1010: manufactured by Ciba-Geigy Japan) | 6 parts |
| Dichloromethane | 2000 parts |
| Silicone oil (KF-54: manufactured by a Shin-Etsu Chemical Co., Ltd. company) | 1 part |

The above-mentioned compositions were mixed and dissolved, thereby a charge transporting layer coating solution was prepared. The charge transporting layer of 20 μm of thickness of dried coating layer was formed with this coating solution by the immersion coating method on the above-mentioned charge generation layer.

| <Surface layer> | |
|---|---|
| Charge transportation material (4,4'-dimethyl-4''-(α-phenylstyryl) triphenylamine) | 225 parts |
| Polycarbonate (TS2050: manufactured by Teijin Chemicals) | 300 parts |
| Hydrophobic silica (dimethylsiliconization, quantity average particle diameter: 60 nm) | 60 parts |
| Antioxidant (LS2626: manufactured by an SANKYO CO., LTD. company) | 6 parts |
| 1,3-dioxolan | 2000 parts |

-continued

| <Surface layer> | |
|---|---|
| Silicone oil (KF-54: manufactured by a Shin-Etsu Chemical Co., Ltd. company) | 1 parts |

The above-mentioned compositions were mixed, the circulation homogenization apparatus which can irradiate supersonic wave performed circulation dispersion, thereby the surface layer coating solution was prepared. This coating solution was coated to become 5 μm of thickness of a dried coating layer by a cylinder type amount-regulating type coating method on the above-mentioned charge transporting layer, a drying process was performed at 110 degrees C. for 70 minutes, thereby the photoreceptor 1 was produced.

Production of Photoreceptors 2-16

Photoreceptors 2-16 of Table 1 were produced as same as the production of Photoreceptor 1, except that the average particle diameter and the added amount of silica of a surface layer and a surface roughness Rz of a base support were changed in the production of Photoreceptor 1.

TABLE 1

| Photorecepter No. | Roughness of conductive base support (μm) | Number average first-order particle size of hydrophobic silica (nm) | Added amount of hydrophobic silica | Surface treating agent for hydrophobic silica | Hydrophobilized degree of hydrophobic silica (%) |
|---|---|---|---|---|---|
| 1 | 1.3 | 60 | 20 | Dimethylsilicone | 76 |
| 2 | 1.3 | 40 | 10 | Hexamethyldisilazane | 80 |
| 3 | 1.3 | 80 | 20 | Methacryloxysilane | 72 |
| 4 | 1.3 | 35 | 50 | Hexamethyldisilazane | 73 |
| 5 | 0.9 | 35 | 20 | Aminosilane/ hexamethylsilazane | 63 |
| 6 | 0.1 | 35 | 10 | Hexamethyldisilazane | 73 |
| 7 | 2.5 | 35 | 40 | Hexamethyldisilazane | 73 |
| 8 | 1.3 | 12 | 10 | Octylsilane | 72 |
| 9 | 1.3 | 12 | 2 | Dimethyldichlorosilan | 71 |
| 10 | 1.3 | 120 | 10 | Hexamethyldisilazane | 72 |
| 11 | 1.3 | 200 | 10 | Octylsilane | 72 |
| 12 | 0.72 | 35 | 20 | Hexamethyldisilazane | 73 |
| 13 | 1.9 | 35 | 30 | Hexamethyldisilazane | 73 |
| 14 | 1.6 | 35 | 20 | Aminosilane/ hexamethylsilazane | 63 |
| 15 | 1.6 | 35 | 20 | Hexamethyldisilazane | 73 |
| 16 | 1.3 | Nil | 0 | — | — |

Evaluation

Measurement of the surface roughness Ra and Rz of a photoreceptor

The surface roughness Ra and Rz of the photoreceptors were evaluated with the method described above.

Image evaluation

A digital process copying machine Konica7075 (it comprises a process employing a corona discharge, a laser light exposure, a reversal development, an electrostatic image transfer, a claw separation, a blade cleaning, and a cleaning auxiliary brush roller 622 adoption process) by Konica Corp. was employed as an evaluation, and then Photoreceptors 1-16 were mounted on this copying machine and evaluated. An original image including a character picture image having a pixel rate of 7%, a person facial photographic image, a solid white image and a black solid image divided into a ¼ equal part was copied to A4 neutralized-paper, and a cleaning ability and an image evaluation were performed for it. A continuous 200,000 copies were carried out under a high-temperature and high humidity ambient (30 degrees C., 80% RH) which seems to be the severest copy condition, and then the evaluation was conducted for them.

Evaluation Criteria

Image density (it was measured using Macbeth RD-918 with a relative reflection density on to the reflection density of paper set at "0".

A: Not less than 1.2: good

B: less than 1.2-1.0

C: less than 1.0

Sharpness (sharpness was evaluated by a character picture image after a 200,000-sheet copy was completed)

The character picture image of 3 points and 5 points was formed, and evaluated with the following criterion of judgment.

A: Both of the 3 points and 5 point was clear and decipherable easily.

B: The 3 points partially was not decipherable, the 5 points were clear and decipherable easily.

C: The 3 points was almost not decipherable and also the 5 points partially or almost was not decipherable.

Transferring ability of toner (the image of 60 mg/cm2 was formed on the photoreceptor after 200,000-sheet copies were completed, the adhesion amount of toner per unit area (fmg/cm2) transferred to the transfer paper was measured, and the transfer rate was calculated by the following calculation.)

Transfer rate of toner=(f/60)×100

A: The transfer rate of toner was 85% or more: Good

B: The transfer rate of toner was 65-84%

C: The transfer rate of toner was 64% or less

Cleaning ability (continuous 10 sheet-copy was performed on A3 paper after 100,000 and a 200,000 copies was completed, and it was judged by presence/absence of cleaning failure in a solid white part)

A: Up to 200,000 sheets, passing-through did not occurred

B: Up to 100,000 sheets, passing-through did not occurred

C: less than 100,000 sheets, passing-through occurred

Blade-twisting (it was judged by occurrence under 200,000-sheet copy)

A: Up to 200,000 sheets, blade-twisting did not occurred

B: Up to 150,000 sheets, blade-twisting did not occurred

C: less than 100,000 sheets, blade-twisting occurred

Blade-singing (it was judged by occurrence under 200,000-sheet copy)

A: Up to 200,000 sheets, blade-singing did not occurred

B: Blade-singing slightly occurred at the time of stopping a drum

C: Blade-singing occurred

Amount of Photoreceptor Coating Thickness Wear

The amount of wear was obtained as a difference of an average coating thickness of the photoreceptor measured at the time of starting evaluation for a practical copy and the time of completing 200,000-sheet copies, and made as the amount of layer thickness wear.

Other Evaluation Condition

Incidentally, other evaluation conditions when using the above konica7075 were set as the following conditions.

Charging Condition

As the charging device, Scorotron charging device was used and the initial charging potential was set as −750V.

Exposure Situation

Exposure amount was set up so that the potential of a light exposure part became −50V.

Developing Condition

DC bias; −550V, A developer including carriers in which a core of a ferrite was coated with an insulating resin and toners in which a silica and a titanium oxide was added externally to coloring particles with a volume average particle diameter of 7.3 μm which was produced from the main material of styrene acryl based resin, colorants, such as carbon black, a electric charge control agent, and low-molecular-weight polyolefin by the polymerizing method, was used.

Transfer condition

Transfer electrode; Corona discharge type

Cleaning condition

Cleaning blade having hardness of 70, rebound resilience of 65%, thickness of 2 (mm), and free length of 9 mm were brought in contact with a cleaning section in the counter direction with a weight load method so that a line pressure becomes 18 (N/m).

The evaluation result was shown in Table 2.

TABLE 2

| Photo-recepter No. | Number average first-order particle size of hydrophobic silica (nm) | $R_a$ Surface roughness of a photoreceptor (μm) | $R_z$ Surface roughness of a photoreceptor (μm) | Image density | Sharp-ness | Transferring ability of toner | Cleaning ability | Blade-twisting | Blade-singing | Amount of layer thickness wear of photorecepter (μm) | Remarks |
|---|---|---|---|---|---|---|---|---|---|---|---|
| 1 | 60 | 0.053 | 0.41 | A | A | A | A | A | A | 1.1 | In. |
| 2 | 40 | 0.031 | 0.35 | A | A | A | A | A | A | 1.2 | In. |
| 3 | 80 | 0.093 | 0.58 | A | B | A | B | A | A | 0.9 | In. |
| 4 | 35 | 0.032 | 0.44 | A | A | A | A | A | A | 1.3 | In. |
| 5 | 35 | 0.023 | 0.33 | A | B | B | B | B | B | 1.7 | In. |
| 6 | 35 | 0.023 | 0.08 | B | B | B | C | C | C | 2.8 | Out. |
| 7 | 35 | 0.031 | 1.05 | B | B | B | C | B | B | 1.8 | Out. |
| 8 | 12 | 0.021 | 0.41 | A | B | B | B | B | B | 1.8 | In. |
| 9 | 12 | 0.012 | 0.46 | B | B | C | C | C | C | 3.5 | Out. |
| 10 | 120 | 0.097 | 0.51 | A | B | B | B | B | B | 0.6 | In. |
| 11 | 200 | 0.113 | 0.58 | A | C | C | C | C | C | 0.3 | Out. |
| 12 | 35 | 0.028 | 0.25 | A | A | A | B | B | B | 1.9 | In. |
| 13 | 35 | 0.032 | 0.98 | A | B | A | B | A | A | 1.5 | In. |
| 14 | 35 | 0.035 | 0.81 | A | A | A | B | A | A | 1.4 | In. |
| 15 | 35 | 0.032 | 0.82 | A | A | A | A | A | A | 1.4 | In. |
| 16 | Nil | 0.008 | 0.42 | B | A | C | C | C | C | 5.2 | Out. |

In.: Inside of the invention
Out.: Outside of the invention

Layer Thickness Measuring Method

The layer thickness of a light sensitive layer was measured at ten uniform layer thickness parts at random, and the mean value of them was used as the layer thickness of the light sensitive layer. It was carried out using the layer thickness instrument of an eddy current type EDDY 560C (manufactured by HELMUT FISCHER GMBTE CO) as a layer thickness instrument, and a difference of the light sensitive layer thickness before and after actual copy tests was made as the amount of layer thickness wear.

Although, Photoreceptors 1-5, and 8, 10, 12-15 show the good result in all evaluation criteria, such as an image density, a sharpness, a toner transferring ability, and cleaning ability, Photoreceptor 6 whose surface roughness Rz is 0.08 μm, the evaluation about cleanings, such as cleaning ability, a blade-twisting, and a blade-singing, are not good. On the other hand, in the photoreceptor 7 whose surface roughness Rz is 1.05 μm, cleaning ability became deteriorated. Moreover, as for the photoreceptor 9 whose surface roughness Ra is 0.012 μm, and the photoreceptor 16 whose Ra is 0.008 μm, in addition to cleaning characteristics, the toner transferring ability is also lowered. As for the photoreceptor 11 whose Ra is 0.113 μm, further it is also found out that sharpness is lowered. Namely, in the above Photoreceptors 1-5, 8, 10, 12-15, the toner transferring ability and the cleaning ability were improved so that even if a toner removing device of a blade cleaning method was used, blade-twisting and blade-singing did not occur and wear resistance could be improved. As clearly can be apparent from examples, the electrophotography photoreceptor showing high durability and improved both cleaning ability and a blade-singing could be offered. Moveover, the imate formation method, the image formation apparatus, and the process cartridge which can attain the good electrophotography image using this electrophotography photoreceptor could be offered.

What is claimed is:

1. An organic photoreceptor for an electro-photography, comprising:

a conductive support member and at least a light sensitive layer;

wherein a toner image forming surface has a surface roughness Ra between 0.02 μm and 0.1 μm and a surface roughness Rz between 0.1 μm and 1 μm and a surface layer of the organic photoreceptor contains inorganic particles.

2. The organic photoreceptor of claim 1, wherein the inorganic particles having a number-based average primary particle diameter from 1 nm to less than 100 nm.

3. The organic photoreceptor of claim 2, wherein the inorganic particles are hydrophobic silica and the hydrophobicity of the hydrophobic silica is 50% or more.

4. The organic photoreceptor of claim 2, wherein the light sensitive layer comprises plural charge transporting layers and the uppermost layer of the plural charge transporting layers is the surface layer.

5. The organic photoreceptor of claim 2, wherein the surface layer contains a binder resin of a polycarbonate resin.

6. The organic photoreceptor of claim 2, wherein the number-based average primary particle diameter is from 10 nm to 90 nm.

7. The organic photoreceptor of claim 2, wherein the number-based average primary particle diameter is from 10 nm to less than 50 nm.

8. The organic photoreceptor of claim 2, wherein the inorganic particles contain at least one of silica, zinc oxide, titanium oxide, tin oxide, antimony oxide, indium oxide bismuth oxide, tin-doped indium oxide, antimony- or tantalumdoped tin oxide and zirconium oxide.

9. The organic photoreceptor of claim 1, wherein the surface roughness Ra is from 0.03 μm to 0.06 μm.

10. The organic photoreceptor of claim 9, wherein the surface roughness Rz is from 0.03 μm to 0.85 μm.

11. The organic photoreceptor of claim 10, wherein a surface layer of the organic photoreceptor contains inorganic particles having a number-based average particle from 1 mm to less than 100 nm.

12. The organic photoreceptor of claim 11, wherein the inorganic particles are hydrophobic silica and the hydrophobicity of the hydrophobic silica is 50% or more.

13. The organic photoreceptor of claim 11, wherein the light sensitive layer comprises plural charge transporting layers and the uppermost layer of the plural charge transporting layers is the surface layer.

14. The organic photoreceptor of claim 1, wherein the surface roughness Rz is from 0.3 μm to 0.85 μm.

15. An image forming apparatus, comprising the organic photoreceptor described in claim 1.

16. The image forming apparatus of claim 15, wherein a surface layer of the organic photoreceptor contains inorganic particles having a number-based average primary particle diameter from 1 nm to less than 100 nm.

17. The image forming apparatus of claim 16, wherein the inorganic particles are hydrophobic silica and the hydrophobicity of the hydrophobic silica is 50% or more.

18. The image forming apparatus of claim 16, wherein the light sensitive layer comprises plural charge transporting layers and the uppermost layer of the plural charge transporting layers is the surface layer.

19. The image forming apparatus of claim 16, wherein the surface layer contains a binder resin of a polycarbonate resin.

20. The image forming apparatus of claim 16, wherein the number-based average primary particle diameter is from 10 nm to 90 nm.

21. The image forming apparatus of claim 16, wherein the inorganic particles contain at least one of silica, zinc oxide, titanium oxide, tin oxide, antimony oxide, indium oxide, bismuth oxide, tin-doped indium oxide, antimony- or tantalum-doped tin oxide and zirconium oxide.

22. The image forming apparatus of claim 15, wherein the surface roughness Ra is from 0.03 μm to 0.06 μm.

23. The image forming apparatus of claim 22, wherein the surface roughness Rz is from 0.03 μm to 0.85 μm.

24. The image forming apparatus of claim 23, wherein a surface layer of the organic photoreceptor contains inorganic particles having a number-based average particle from 1 nm to less than 100 nm.

25. The image forming apparatus of claim 24, wherein the inorganic particles are hydrophobic silica and the hydrophobicity of the hydrophobic silica is 50% or more.

26. The image forming apparatus of claim 15, wherein the surface roughness Rz is from 0.3 μm to 0.85 μm.

27. An image forming method, comprising:

developing an electrostatic latent image formed on the organic photoreceptor described in claim 1.

28. The organic photoreceptor of claim 2, wherein the surface of the support on a side the light sensitive layer is provided on or over the substrate has a surface roughness of Rz from not less than 0.5 μm to less than 2.5 μm so that the Rz of the surface layer of the photoreceptor can be controlled, the surface roughness Ra of the photoreceptor is from 0.03 μm to 0.6 μm, and the surface roughness Rz of the photoreceptor is from 0.3 μm to 0.85 μm.

* * * * *